US010360786B2

(12) United States Patent
Christensen

(10) Patent No.: US 10,360,786 B2
(45) Date of Patent: Jul. 23, 2019

(54) HYGIENE NUDGING SYSTEM

(71) Applicant: CONCEPTMAKING APS, Højbjerg (DK)

(72) Inventor: Jarl Christensen, Højbjerg (DK)

(73) Assignee: Conceptmaking ApS, Højbjerg (DK)

( * ) Notice: Subject to any disclaimer, the term of this patent is extended or adjusted under 35 U.S.C. 154(b) by 0 days.

(21) Appl. No.: 15/765,865

(22) PCT Filed: Oct. 5, 2016

(86) PCT No.: PCT/EP2016/073786
§ 371 (c)(1),
(2) Date: Apr. 4, 2018

(87) PCT Pub. No.: WO2017/060297
PCT Pub. Date: Apr. 13, 2017

(65) Prior Publication Data

US 2018/0286215 A1 Oct. 4, 2018

(30) Foreign Application Priority Data

Oct. 5, 2015 (EP) ..... 15188334

(51) Int. Cl.
*G08B 21/24* (2006.01)
*A47K 10/42* (2006.01)
*A47K 10/32* (2006.01)

(52) U.S. Cl.
CPC ..... *G08B 21/245* (2013.01); *A47K 10/421* (2013.01); *A47K 2010/3266* (2013.01)

(58) Field of Classification Search
CPC ..... A61B 5/746; A61B 5/024
(Continued)

(56) References Cited

U.S. PATENT DOCUMENTS

2002/0000449 A1 1/2002 Armstrong
2006/0154222 A1* 7/2006 Lane ..... G09B 23/28 434/262

(Continued)

FOREIGN PATENT DOCUMENTS

WO WO 2010/065402 6/2010

OTHER PUBLICATIONS

International Search Report and Written Opinion of the ISA for PCT/EP2016/073786, dated Dec. 20, 2016, 17 pages.

*Primary Examiner* — Joseph H Feild
*Assistant Examiner* — Sharmin Akhter
(74) *Attorney, Agent, or Firm* — Nixon & Vanderhye P.C.

(57) ABSTRACT

The present invention relates to a hygiene nudging system for improving the overall cleanliness of a room or an area having one or more predetermined surfaces, comprising a dispenser unit configured to dispense cleaning wipes for cleaning the one or more surfaces, a control unit connected with the dispenser unit, wherein the system comprises a nudging unit connected with the control unit, the control unit being configured to control the nudging unit, the nudging unit is configured to issue an indication when activated by the control unit, and a first sensor is connected with the dispenser unit and the control unit, the first sensor being configured to detect dispensing from the dispenser unit and to signal the detection of dispensing to the control unit, whereby the control unit deactivates the nudging unit. The present invention also relates to a facility comprising one or more hygiene nudging systems according to the present invention. Further, the present invention relates to a monitoring and nudging system, to a method for improving an overall cleanliness of a room or an area and to use of the hygiene nudging system according to the present invention.

22 Claims, 5 Drawing Sheets

(58) Field of Classification Search
USPC ..... 340/573.1
See application file for complete search history.

(56) References Cited

U.S. PATENT DOCUMENTS

| | | | | |
|---|---|---|---|---|
| 2007/0257803 | A1* | 11/2007 | Munro | G08B 21/245 340/573.1 |
| 2009/0224924 | A1 | 9/2009 | Thorp | |
| 2010/0238021 | A1* | 9/2010 | Harris | A47K 5/06 340/539.11 |
| 2012/0154582 | A1* | 6/2012 | Johnson | G06F 19/321 348/143 |
| 2012/0212344 | A1 | 8/2012 | Forsberg et al. | |
| 2016/0180695 | A1* | 6/2016 | Levchenko | G08B 21/245 340/573.1 |

* cited by examiner

HYGIENE NUDGING SYSTEM

This application is the U.S. national phase of International Application No. PCT/EP2016/073786 filed 5 Oct. 2016, which designated the U.S. and claims priority to EP Patent Application No. 15188334.5 filed 5 Oct. 2015, the entire contents of each of which are hereby incorporated by reference.

FIELD OF THE INVENTION

The present invention relates to a hygiene nudging system for improving the overall cleanliness of a room or an area. The present invention also relates to a facility comprising one or more hygiene nudging systems according to the present invention. Further, the present invention relates to a monitoring and nudging system, to a method for improving an overall cleanliness of a room or an area and to use of the hygiene nudging system according to the present invention.

BACKGROUND ART

Many people consider cleaning an insignificant low status job with no development opportunities. Most people are taught how to clean by their parents, and people usually do it in their own homes. A trivial job which most people want to get done as quickly as possible.

This attitude is actually a very good indication of the focus we want to put on cleaning. Similarly, the daily handling of cleaning procedures in e.g. hospitals is deprioritised in favour of treatment, care and research.

In Denmark, billions are spent each year on cleaning, since it is a priority to create a good environment in public buildings, facilities and institutions which constitute the framework for learning, health treatment and care, as well as for administration citizen service.

But despite the extensive amounts allocated to this area, the level of cleanliness in schools, day care facilities, hospitals and other public buildings is often criticised, and public authorities are accused of not allocating sufficient funds for this extensive cleaning task. Most often cleaning is performed once a day, typically in the morning, which means that during the day dirt and bacteria accumulate.

Naturally, the schools, institutions and hospitals are used by a high number of children and adults every day, and hence, as the day progresses, dirt, bacteria and vira will accumulate. The challenge is that an unclean environment affects people's well-being and health. Depending on the context, an unclean environment may have different consequences. It is not difficult to imagine that in schools, unclean surroundings can affect children's readiness to learn. It is difficult for a child to focus and concentrate if, for instance, it has a stomach ache caused by contamination by a pathogenic alimentary tract bacteria. And in the event that the child is so ill that it has to stay at home, it is precluded from participating in academic and social learning processes. In hospitals and nursing homes, where the patients/residents often have weak immune systems, an unclean environment can be life-threatening. Every year the number of people dying from hospital acquired infections far exceeds the number of people dying in traffic accidents.

Macro-economically, there is a great potential in cleaning which, if planned and performed wisely, may reduce contamination and spread of infections and hence save society billions in the form of expenses saved associated with sick days and hospital readmissions.

As mentioned above, rooms and areas are often only cleaned once per day, even though they may have a high level of activity and thereby load. This influences the overall cleanliness of the room or area and especially of critical surfaces in the rooms/areas, i.e. surfaces often touched by human hands and/or fingers, and from which surfaces micro-organisms can thus easily spread. There is therefore a need for providing a solution which facilitates more cleaning of the critical surfaces in the rooms/areas.

SUMMARY OF THE INVENTION

It is an object of the present invention to wholly or partly overcome the above disadvantages and drawbacks of the prior art. More specifically, it is an object to provide an improved hygiene nudging system assisting in enhancing the overall cleanliness of a room or an area in order to minimise the spread of micro-organisms that could cause infections to spread from surfaces.

The above objects, together with numerous other objects, advantages and features, which will become evident from the below description, are accomplished by a solution in accordance with the present invention by a hygiene nudging system for improving the overall cleanliness of a room or an area having one or more predetermined surfaces, comprising

- a dispenser unit configured to dispense cleaning wipes for cleaning the one or more surfaces,
- a control unit connected with the dispenser unit,
- wherein the system comprises a nudging unit connected with the control unit, the control unit being configured to control the nudging unit, the nudging unit is configured to issue an indication when activated by the control unit, and
- a first sensor is connected with the dispenser unit and the control unit, the first sensor being configured to detect dispensing from the dispenser unit and to signal the detection of dispensing to the control unit, whereby the control unit deactivates the nudging unit.

By the system according to the invention it is possible to provide extended cleaning activities which are user-initiated and on demand.

The control unit may be configured to deactivate the nudging unit after a predetermined time span and/or after a predetermined number of cleaning wipes having been dispensed from the dispenser unit.

In addition, the dispenser unit may comprise the control unit, the nudging unit and the first sensor so that the entire hygiene nudging system is comprised in one item.

The dispenser unit may comprise a cleaning wipe dispenser with a supply of wet cleaning wipes, the wet cleaning wipes being wetted by a first disinfectant.

Also, the dispenser unit may comprise an additional cleaning wipe dispenser with an additional supply of wet cleaning wipes, the additional wet cleaning wipes being wetted by a second disinfectant, the first disinfectant being different from the second disinfectant.

The supply of wet cleaning wipes may be changed for a specific dispenser unit, so that subsequent to wet cleaning wipes having a first disinfectant having been used, wet cleaning wipes having a second disinfectant may be inserted into the dispenser unit. In addition, in some circumstances it may be necessary to immediately change the wet cleaning wipes present in the dispenser unit to another type of wet cleaning wipes having another disinfectant, for instance if an outbreak of e.g. Methicillin Resistente Staphylococcus Aureus (MRSA) or similar has been identified.

Moreover, the dispenser unit may comprise a cleaning wipe dispenser with a supply of cleaning wipes and a first disinfectant dispenser.

Furthermore, the first disinfectant dispenser may have a first disinfectant and the dispenser unit may comprise a second disinfectant dispenser having a second disinfectant, the first disinfectant being different from the second disinfectant.

The dispenser unit may comprise a space configured to receive the supply of wet cleaning wipes. The wet cleaning wipes are contained in a refill part configured to be inserted into the space of the dispenser unit.

The system may also comprise a plurality of refill parts with wet cleaning wipes to be inserted into the dispenser unit.

A first refill part may have a first indication indicating that the wet cleaning wipes present in the first refill part are wetted by a first disinfectant.

A second refill part may have a second indication indicating that the wet cleaning wipes present in the second refill part are wetted by a second disinfectant different from the first disinfectant.

The system may be able to detect electronically and/or mechanically which wet cleaning wipes are present inside the dispenser unit.

In addition, the dispenser unit may be configured to dispense cleaning wipes and/or disinfectant touch-free.

The dispenser unit may comprise a movement sensor configured to detect movement, whereby the cleaning wipe dispenser and/or disinfectant dispenser is/are activated for dispensing.

Moreover, the dispenser unit may comprise a power supply.

Such power supply may be a battery pack.

Also, the first sensor may be configured to detect consumption of cleaning wipes and/or disinfectant.

Furthermore, the indication may be light, colour, sound and/or vibration.

The hygiene nudging system according to the present invention may further comprise a second sensor configured to detect movements in the room and load of the room.

The second sensor may be configured to detect light, $CO_2$, temperature, humidity and/or noise.

The second sensor may be configured to detect sound so that the system, on the basis of the sound detection in a specific room or area, may detect the room load, i.e. the amount of human activity in rooms/areas.

Further, the second sensor may be a passive infrared (PIR) sensor.

Moreover, the PIR sensor may be arranged in a ceiling or a wall of the room or area to detect movement of a person in the room or area.

In an embodiment, the second sensor may be a LIDAR sensor. A LIDAR sensor is a remote sensing technology that measures distance by illuminating a target with a laser and analysing the reflected light. LIDAR allows any physical object in a room or an area to be re-created in a computer environment.

The LIDAR sensor may be configured to detect the whereabouts of persons in a room or an area. Hence the LIDAR sensor is capable of identifying which room or area has been used and how much. In addition, the LIDAR sensor may be configured to detect which surfaces have been touched by the persons in the room or area. By means of the detection of the LIDAR sensor it is possible to analyse the movement of persons, the touch of surfaces and room load (i.e. the amount of human activity in rooms/areas). The analysis may be used to facilitate just-in-time and very precise cleaning of relevant surfaces of a room or an area by using the hygiene nudging system according to the present invention.

The dispenser unit may also comprise the second sensor.

Also, the control unit may be configured to store data regarding signals received from the sensors.

Furthermore, the control unit may be configured to activate the nudging unit at predetermined time intervals.

Additionally, the control unit may be configured to activate and deactivate the nudging unit at predetermined times.

The control unit may be configured to activate the nudging unit on the basis of data received from the sensor(s).

The control unit may be configured to activate/deactivate the nudging unit on the basis of data received from other systems.

Further, the control unit may be configured to deactivate the nudging unit when the dispenser unit has not dispensed any cleaning wipes for a predetermined period of time.

Also, the control unit may comprise a communication unit. The communication unit may be configured to communicate continuously and/or a predetermined time intervals.

One or more stickers or indicators may be provided on the predetermined surfaces in the room or area for guiding a person to the predetermined surfaces to be wiped by means of the cleaning wipes dispensed from the dispenser unit.

In addition, the system may comprise an illumination unit which is configured to illuminate the predetermined surfaces in the room or area for guiding a person to the predetermined surfaces to be wiped by means of the cleaning wipes dispensed from the dispenser unit.

Furthermore, one or more bio-sensors may be arranged on surfaces which by experience are exposed to a high touch load. The bio-sensors are configured to automatically notify the system that the cleanliness of the surface exceeds a predetermined level, whereby the system will start nudging the users of the room.

The surfaces which by experience are exposed to a high touch load may be coated with a bio-coating, the bio-coating being configured to change colour or structure when the cleanliness of the surface exceeds a predetermined level for guiding a person to the predetermined surfaces to be wiped by means of the cleaning wipes dispensed from the dispenser unit Moreover, the predetermined surfaces may be the surfaces in the room or area which are most frequently touched by persons present in the room or area. When applying a sensor configured to detect the room load as well as where in the room/area the persons are present, it is, over time, possible to detect which surfaces have the largest touch load, which surfaces may then be identified as the predetermined surfaces.

Furthermore, a guideline to the hygiene nudging system may be arranged at the dispenser unit, or virtual guideline may be provided.

Said guideline may be shown on a poster or a sticker placed on a wall, a door or on a display.

The guideline may also be accessible via online media, for instance via the internet or via a mobile app. For instance the users may have access to the guideline via their tablet and/or smartphone. For instance the users may scan a QR code present on a poster or at the dispensers, which provides access to an app to be downloaded to their tablet and/or smartphone, which will then provide access to the guideline and/or an online version of the hygiene nudging system.

In addition, the system may also comprise a motivation module. The motivation module is configured to maintain the user's interest and motivation for the cleaning of the predetermined surfaces. The motivation module may be configured to use gamification as a motivation factor. For instance, when the hygiene nudging system is arranged at schools, it may be advantageous to motivate the young pupils via gamification. This may for instance be implemented by the motivation module having a timing possibility, whereby the user is asked to start the time when he or she starts the wiping of surfaces, and to stop the time when all predetermined surfaces have been wiped.

The present invention also relates to a facility comprising one or more hygiene nudging systems as described above.

Furthermore, the present invention relates to a monitoring and nudging system comprising a central control unit configured to receive data from one or more hygiene nudging system(s) as described above.

The central control unit is configured to control a plurality of hygiene nudging systems. The separate hygiene nudging system may be self-controlled. However, it is expedient if several hygiene nudging systems are connected with the central control unit for being controlled by this central control unit.

Each separate hygiene nudging system of a facility may be an Internet-of-Things (IoT) which is connected with other embedded systems for providing the overall monitoring and nudging system.

The IoT is the internet working in physical devices, vehicles, buildings and other items embedded with electronics, software, sensors, actuators, and network connectivity that enable these objects to collect and exchange data.

The monitoring and nudging system may also be connected with other information sources in order to enhance the overall cleanliness of the room. The other information sources may for instance be the facility's ERP system which contains information regarding the sickness absence of the facility. The monitoring and nudging system is configured to apply this information to control the separate hygiene nudging systems by initiating a higher nudging frequency than if less or no sickness absence has been recorded.

In addition, by monitoring the room load by one or more of the sensors in the hygiene nudging system, data and knowledge are being collected in view of specific rooms or areas, which data and knowledge contribute to the understanding of the room load, which understanding may then be used to control the effort of the conventional cleaning of the rooms and areas in question.

Also, the present invention relates to a method for improving an overall cleanliness of a room or an area having one or more predetermined surfaces, comprising:

arranging a hygiene nudging system as described above, activating the nudging unit for guiding a person in the room or area to the dispenser unit via an indication, and dispensing a cleaning wipe to the person for encouraging the person to take the cleaning wipe for cleaning one or more of the predetermined surfaces.

The method as described above may further comprise detecting the dispensing of a cleaning wipe, and deactivating the indication of the nudging unit.

The method may also comprise one of the following detecting a sick-absence level, detecting light, $CO_2$ level, temperature, humidity and/or noise level in the room or area, and/or detecting un-clean surfaces via surface bio-sensors.

When detecting sick-absence, it is possible to show the actual sick-absence level for a specific room or facility, for instance a school in real time. It would also be possible to show the actual sick-absence level for all schools in a municipality, or even all schools in the country in real time for the users of the present invention. Hereby it is obtained that the system may be used to document whether the sick-absence level is decreasing or increasing.

When applying this sick-absence detection, it will be possible to predict irregular sick-absence conditions. For instance, if one person from a specific room is sick one day, and if the day after it is detected that three persons from the same room are sick, there may be a risk that other persons in that same room in combination with persons of neighbouring rooms are going to be sick. It is thereby possible to establish a predictive analysis of the situation, and by applying the present invention, it would be possible to anticipate the unintended spread of infectious disease by nudging the users to wipe off the predetermined surfaces more frequently, and at the same time provide more thorough conventional cleaning of the rooms and areas in question.

Predictive analytics encompasses a variety of statistical techniques from predictive modelling, machine learning, and data mining that analyse current and historical facts to make predictions about future or otherwise unknown events.

According to the inventive idea, user-guidance of the system may be further developed. For instance the user-guidance may vary during the course of a year, in that the system will nudge more frequently during the autumn and winter than during spring and summer time.

Other nudging facilities may also be incorporated into the system, for instance the system may be set to nudge in respect of other activities, such as for instance "reminder sun screen", "drink water", "go outside—the $CO_2$ level is too high", "stand up and move around", and similar.

Said method may also comprise reactivating the nudging unit after a predetermined period of time and/or after detecting a load of the room or area above a certain threshold.

Also, the method as described above may comprise arranging stickers or indicators on the one or more predetermined surfaces for visualising them for the persons in the room or area.

Further, the method as described above may comprise deactivating the nudging unit if no action from a person is detected for a predetermined period of time.

In addition, the method may comprise summoning cleaning personal for handling the cleaning of the predetermined surfaces if activity in the room or area in question has been detected and present in the room or area has not acted on the nudging by the system.

Moreover, in hospitals the dispense units may be connected with the hospital staff, for instance via RFID chips in staff admission cards (ID cards) or in their uniforms, so that when a hospital staff is in the vicinity of a dispense unit, he or she may be nudged by the dispense unit "by a professional indication", for instance of another colour, if the user has not acted on the nudging sequence.

The present invention also relates to use of the hygiene nudging system as described above in hospitals, day care centres, schools, institutions, public buildings, pharmaceutical companies, the food industry, restaurants, offices, meeting rooms etc.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
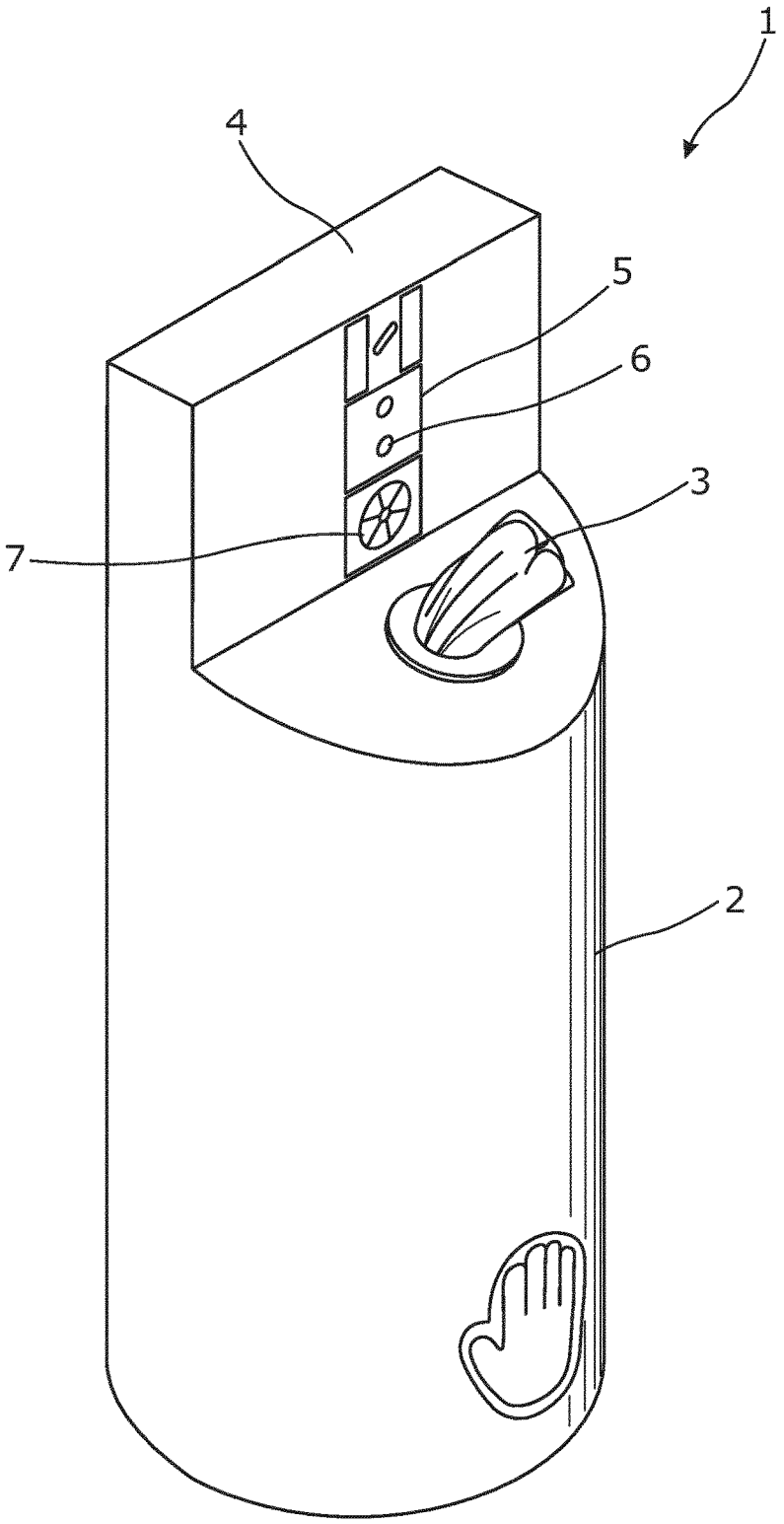
FIG. 1 shows a hygiene nudging system according to the invention.

FIG. 1 shows the hygiene nudging system 1 for improving an overall cleanliness of a room (not shown) or an area having one or more predetermined surfaces (not shown). In the present embodiment, the hygiene nudging system 1 comprises dispenser unit 2 configured to dispense cleaning wipes 3 for cleaning the one or more surfaces. A control unit 4 is connected with the dispenser unit 2. The hygiene nudging system 1 furthermore comprises a nudging unit 5 connected with the control unit 4, the control unit 4 being configured to control the nudging unit 5, and the nudging unit 5 is configured to issue an indication 6 when activated by the control unit 4. The indication 6 is here shown as light diodes. However, the indication may be light, illumination, sound and/or vibration.

Furthermore, a first sensor 7 is connected with the dispenser unit 2 and the control unit 4, the first sensor 7 being configured to detect dispensing from the dispenser unit 2 and to signal the detection of dispensing to the control unit, whereby the control unit deactivates the nudging unit 5. In FIG. 1, the hygiene nudging system 1 is assembled in the same device. However, in other embodiments, the different units may be separated partly or fully.

By the present invention it is possible to clean hand-touch-sites and relevant surfaces timely to remove/reduce the infectious agent present on the surfaces and thus impede and prevent the spread of micro-organisms that could cause infections.

The hygiene nudging system 1 may advantageously supplement cleaning practises with focus on timely cleaning of hand-touch-sites and relevant surfaces. The hygiene nudging system 1 is equipped with nudging capabilities to nudge/guide people to perform timely cleaning of hand-touch-sites and relevant surfaces by the use simple disinfecting wipes located near critical areas. Hereby, the hygiene nudging system 1 encourages the users of rooms/areas to take part in ensuring their own safety by improving the overall cleanliness of the room/area.

The dispenser unit 2 may comprise a cleaning wipe dispenser 2 with a supply of wet cleaning wipes 3 as shown in FIG. 1, the wet cleaning wipes 2 being wetted by a first disinfectant.

In another not shown embodiment, the dispenser unit may comprise an additional cleaning wipe dispenser with an additional supply of wet cleaning wipes, so that the dispenser unit has two cleaning wipe dispensers. The additional wet cleaning wipes may be wetted by a second disinfectant, the first disinfectant being different from the second disinfectant. In addition, each cleaning wipe dispenser may have its own nudging unit, whereby the control unit may switch between activating each nudging unit, so that the users are prompted to switch between different disinfectants. Hereby, it is avoided that the micro-organisms become resistant towards a specific disinfectant.

The dispenser unit may also comprise a cleaning wipe dispenser with a supply of cleaning wipes and a first disinfectant dispenser. Hereby the user is nudged to take a cleaning wipe and subsequently dispense a disinfectant onto it via the first disinfectant dispenser. As described above, the first disinfectant dispenser may have a first disinfectant and the dispenser unit may comprise a second disinfectant dispenser having a second disinfectant, the first disinfectant being different from the second disinfectant.

Advantageously, the dispenser unit is configured to dispense cleaning wipes and/or disinfectant touch-free, so that the users do not contaminate the dispenser unit. In addition, a dispenser with disposable gloves may be provided near the dispenser unit, so that the user may wear these before using the cleaning wipes on the surfaces.

In addition, the hygiene nudging system 1 may comprise a second sensor 12 configured to detect movements in the room/area and load of the room/area. The hygiene nudging system may then use real time load measurements (use of rooms/areas etc.) as analytical data to predict (calculate, estimate etc.) the risk of infections (person-to-person or self infectious) and/or to reduce the amount of microorganisms in the environment. The system may get load information from multiple sources: sensors in the room, sensors on the cleaning wipes dispenser, information from other devices and systems, for instance ERP systems etc.

The hygiene nudging system may also gather information about compliance, e.g. a feed back loop that detects if the nudging/guiding is followed by action. This could be a detection if the user actually dispenses cleaning wipes or alcohol swabs after a nudging indication.

The second sensor may detect room load/activity to help guide cleaning activities by understanding and combining room loads and cleaning efforts. It may be able to detect occupancy (room load), light, temperature etc. The sensor may be a passive infrared (PIR) sensor. However, the second sensor may also utilise radar scan technologies such as for instance LIDAR. A LIDAR sensor is a remote sensing technology that measures distance by illuminating a target with a laser and analysing the reflected light. Hereby, the LIDAR scan may gather precise data about rooms/areas, equipment and people.

The hygiene nudging system may comprise another wireless detection sensor configured to detect signals from ID cards or cleaning material/robots, so that the system may identify "professional" personnel or staff in the room/area.

In the embodiment shown in FIG. 1, the control unit is part of the dispenser unit. In other embodiments, the control unit may be a separate unit configured to control a number of dispenser units, nudging units and/or sensors. The control unit may then be configured to communicate with an additional control unit and/or a central control unit as described in more detail below.

Figure 2:
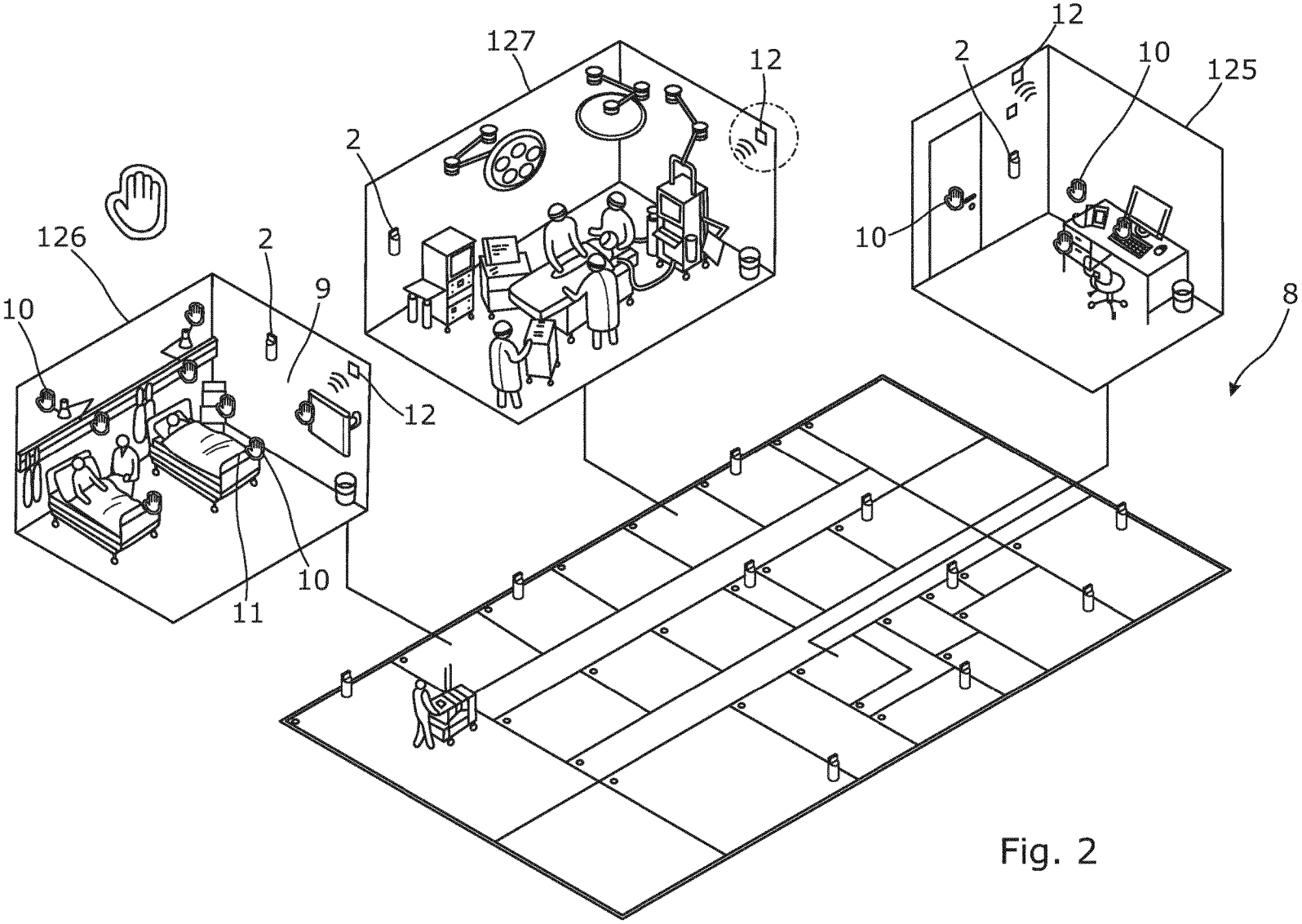
FIG. 2 shows the hygiene nudging system applied in a hospital.

FIG. 2 shows schematically a part of a hospital 8. The hospital 8 may be divided into several zones, such as administrative areas 125, bed wards 126, examining wards, operating rooms 127, lavatories etc. In each room a hygiene nudging system 1 is arranged. In the bed ward 126, the dispenser unit 2 is placed on the wall 9. The nudging unit is, in this embodiment, part of the dispenser unit 2. Several stickers 10 or indicators are provided on the predetermined surfaces 11 in the room or area for guiding a person to the predetermined surfaces to be wiped by means of the cleaning wipes dispensed from the dispenser unit 2. The stickers 10 may be a set of hand-touch-site stickers to guide the users to clean critical surfaces. The stickers are applied on the surfaces that are defined as critical, and the intention is to guide the users to focus on the marked surfaces in the room/area instead of less critical surfaces.

The guidance towards critical surfaces can also be more advanced (e.g. handled electronically by light-guiding—light beams will illuminate the surfaces). This light-guiding could also happen by illumination of hand-touch-sites-stickers with ultraviolet light (the stickers will illuminate more clearly in ultraviolet light).

As described above, second sensors 12 are arranged in each room for assisting in detecting the load and activities in the room.

The control unit may be configured to activate the nudging unit at predetermined time intervals, such as each third hour. The control unit may also be configured to activate and deactivate the nudging unit at predetermined times, such as deactivation during night hours.

The control unit may also be configured to activate the nudging unit on the basis of data received from the second sensor.

Each control unit may be programmed individually in view of the installation, or they may be controlled centrally.

Figure 3:
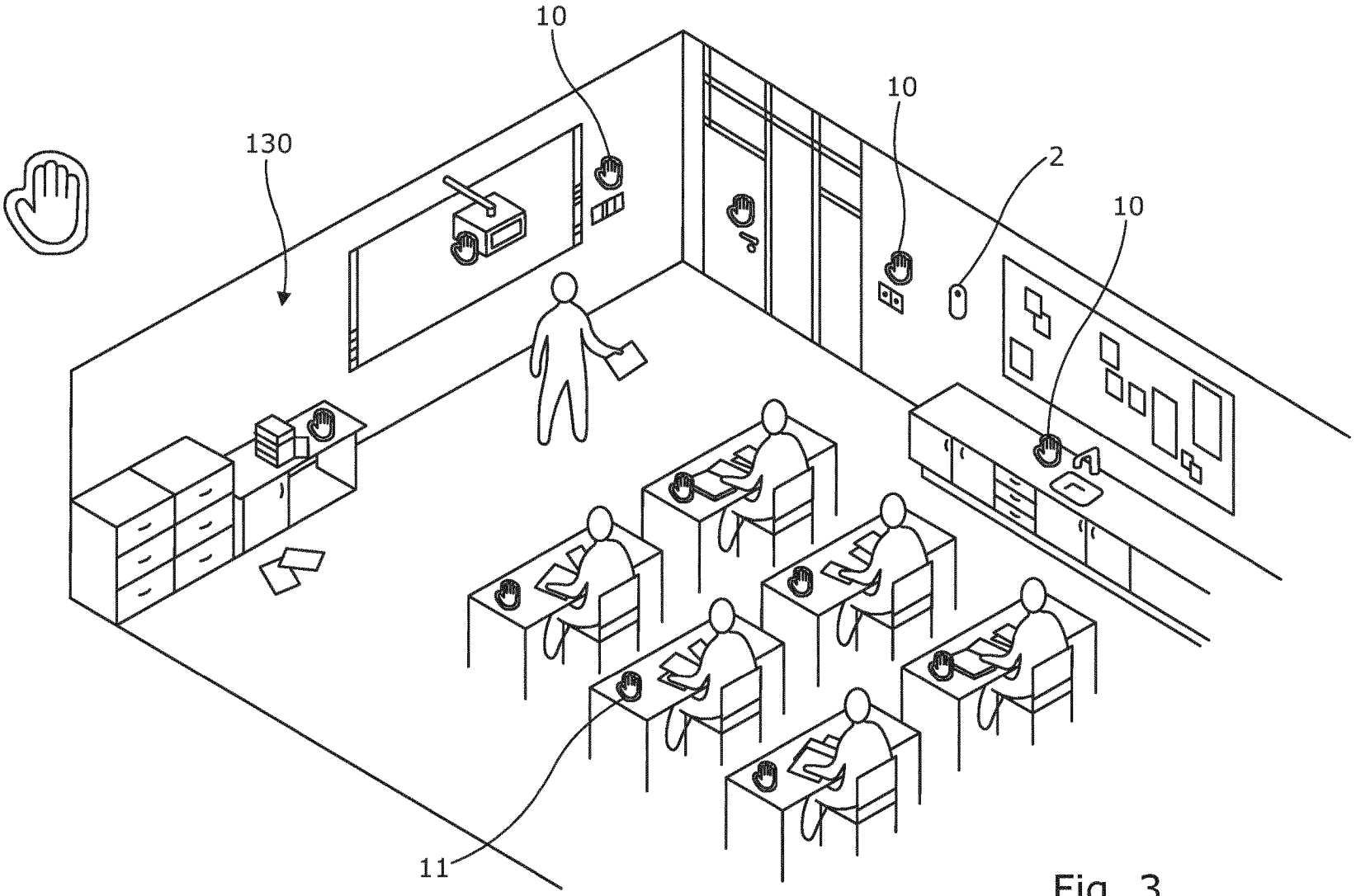
FIG. 3 shows the hygiene nudging system applied in a school or teaching facility.

In FIG. 3, a class room 130 is shown, wherein the hygiene nudging system is arranged. Again the dispenser unit 2 is arranged on a wall, so that it is easily visible and reachable for the persons in the room. Stickers 10 are placed on the most critical surfaces for guiding the persons to clean these surfaces.

The hygiene nudging system according to the present invention was tested at a Danish primary school in a fifth grade class.

The first test iteration was performed just with the introduction to the dispenser unit of the hygiene nudging system and the stickers on surfaces. Before the second test iteration and before introducing gamification, a course for the children aimed at increasing their interest in and knowledge about hygiene and health was conducted.

Several stickers were then applied to predetermined surfaces in the class room, i.e. for instance on tables and handles, i.e. on surfaces having a high touch load. Every morning all pupils were nudged to wipe off their own table, one person in the class was nudged to wipe off other surfaces such as the handle and other predetermined surfaces, and the teacher was nudged to wipe off his/her desk. The same procedure was followed before the lunch break when the pupils and the teacher were nudged once more.

Before the test was conducted, ATP measurements on the predetermined surfaces was performed. The measurements taken before the test showed that 83 percent of the measurements were above the predetermined threshold of contamination.

After the hygiene nudging system according to the invention had been used for a period of time, ATP measurements on the predetermined surfaces were performed again. The measurements for the class performing the cleaning showed that only 3 percent of the measurements taken were above the predetermined threshold of contamination.

Thus, the test showed that the overall contamination of the class room in which the pupils/teachers were nudged at predetermined times was substantially below the predetermined threshold compared to the measurements taken before the test which was substantially above the predetermined threshold. Consequently, the hygiene nudging system proved to exceed expectations and clearly provided increased cleanliness to the room.

In addition, the Danish primary school in which the test was performed has around 1,000 students and teachers. The conventional cleaning of the entire school is performed by four persons every day. Each cleaning person is using approximately three hours per day which adds up to 12 hours of cleaning per day on the entire school.

If the hygiene nudging system according to the present invention was installed in the entire school, and the 1,000 users of the school were activated via the nudging to wipe off predetermined surfaces around 2 times four minutes per day, this would provide an additional 133 hours per day to the cleaning effort of the present school, which indeed would enhance the overall cleanliness of the school with minimum effort.

Figure 4:
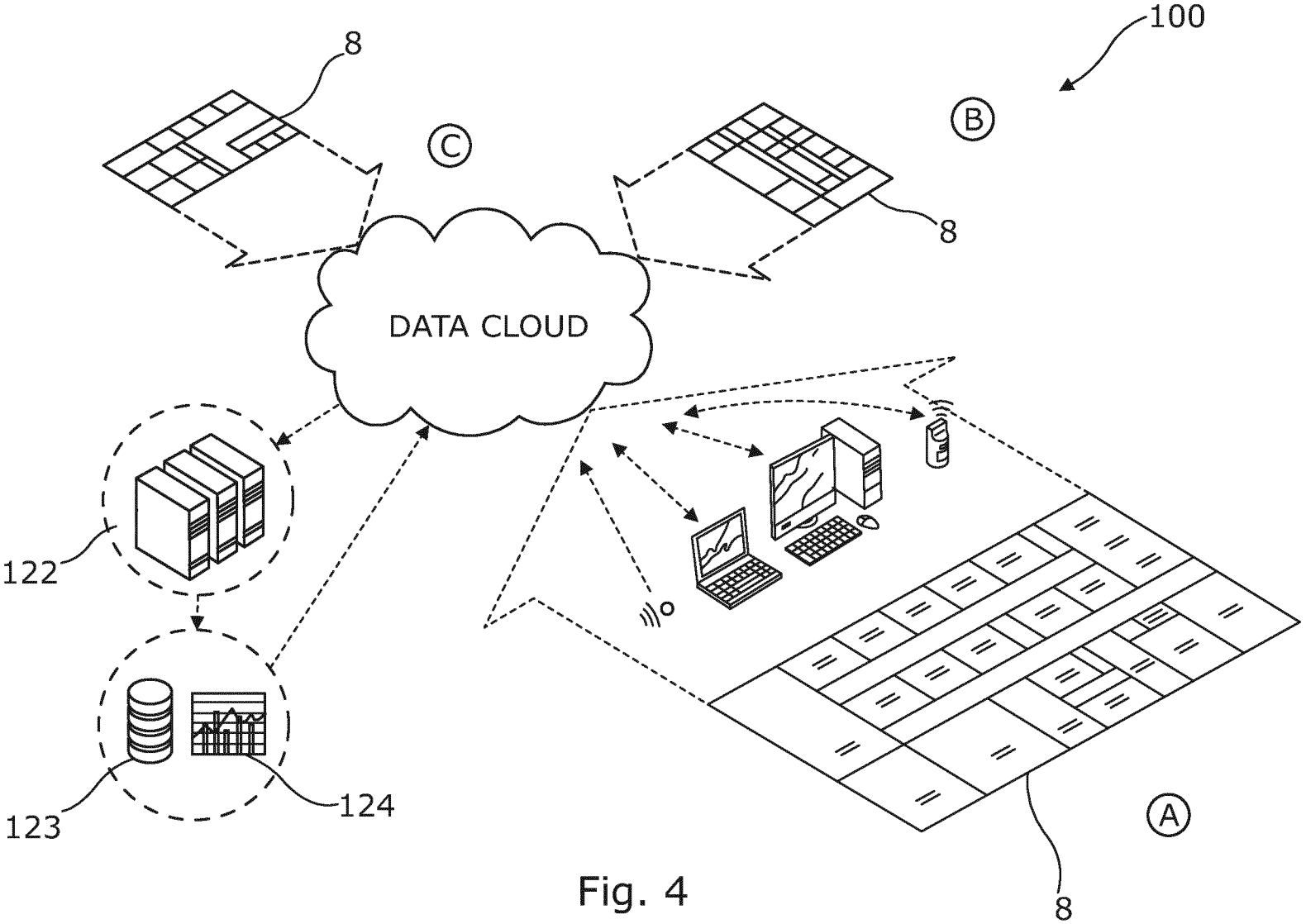
FIG. 4 shows a monitoring system according to the invention.

FIG. 4 shows an embodiment of a monitoring system 100 according to the invention. The monitoring system 100 may be used in one or more facilities or buildings 8. In the present embodiment, the facilities are three hospitals; A, B, and C. Each hospital comprises different rooms and areas having different loads. In each room/area, a hygiene nudging system as described above is installed.

The monitoring system 100 comprises a central control unit 122 connected with the control units of the hygiene nudging systems. The central control unit 122 is wirelessly connected with units and sensors, computers/servers etc. in the respective hospitals and may function as a cloud-based platform accessible for many different hospitals and other facilities. However, in other embodiments, the monitoring system may be set up for one facility only. The central control unit 122 may also comprise databases 123 for storing information and observations as well as data. Furthermore, the central control unit may comprise an analysis module 124 and report modules for presenting the data from the database to relevant persons.

The monitoring system 100 will also, with load sensors and cleaning wipe dispensers (including load sensors) in combination with other data (e.g. ERP data summarising data about people whereabouts), be able to advise where to perform conventional cleaning and when. With operational analytics the system can determine risks and predict where it would be prudent to perform conventional cleaning and when.

Control/operation of the cleaning wipe dispensers can also be controlled from external sources, for instance the monitoring system.

The real time data and real time actions can be used to provide feedback to user groups, e.g. by providing a user website with analytics. Information could be made more visible by displaying it on wall displays or as an app on tablets or smartphones.

The monitoring system together with the hygiene nudging system may provide peer-to-peer comparison (comparison of cleaning activities from different locations, user groups etc.); compliance check (detection of the effect of nudging, establishment of whether supplemental cleaning actions have to be initiated); room load (detection of whether people are present in rooms or areas and assessment of the need for either conventional cleaning or supplemental surface cleaning); activity level (detection of whether e.g. a patient is moving in the room); response time (time before conventional cleaning or supplemental surface cleaning activities are performed after nudging signal); resource use (organisation of cleaning activity from load and wipe detection); quality/safety documentation (document compliance and cleaning activity).

In addition, the dispenser unit may comprise a wireless module with microcontroller and low power radio. It may also have a feedback detection (detection of the use of cleaning wipes).

In addition, the dispenser unit may comprise the control unit and the different sensors for load detection, and hence only one unit is needed in every room/area.

The dispenser unit may also provide information about when it is time for battery change and cleaning wipes refill. This provides no or minimal system down-time.

The hygiene nudging system may also have additional disposal bin possibilities to collect used cleaning wipes.

When the hygiene nudging system comprises an RFID chip detection capability (sensor), it is possible to detect professional staff by means of their ID cards when they enter the room—or are near the room.

If the users do not react to the nudging signal from the nudging unit, the nudging unit will, by means of a special nudging indication (e.g. a combination of light and sound signal dedicated to professionals), indicate this to the next professional staff entering the room.

The different units and sensors may communicate via different protocols and gateways. The gateway may be modular and can handle many different wireless protocols at the same time (e.g. ZigBee, Z-Wave, Wireless M-bus and Wi-Fi). It may also communicate via WAN capabilities such as Ethernet, Wi-Fi or GPRS. In addition, it may communicate fully or partly via a wireless mesh network (WMN). Further, nodes may be arranged between the units in order to facilitate communication between the units.

Figure 5:
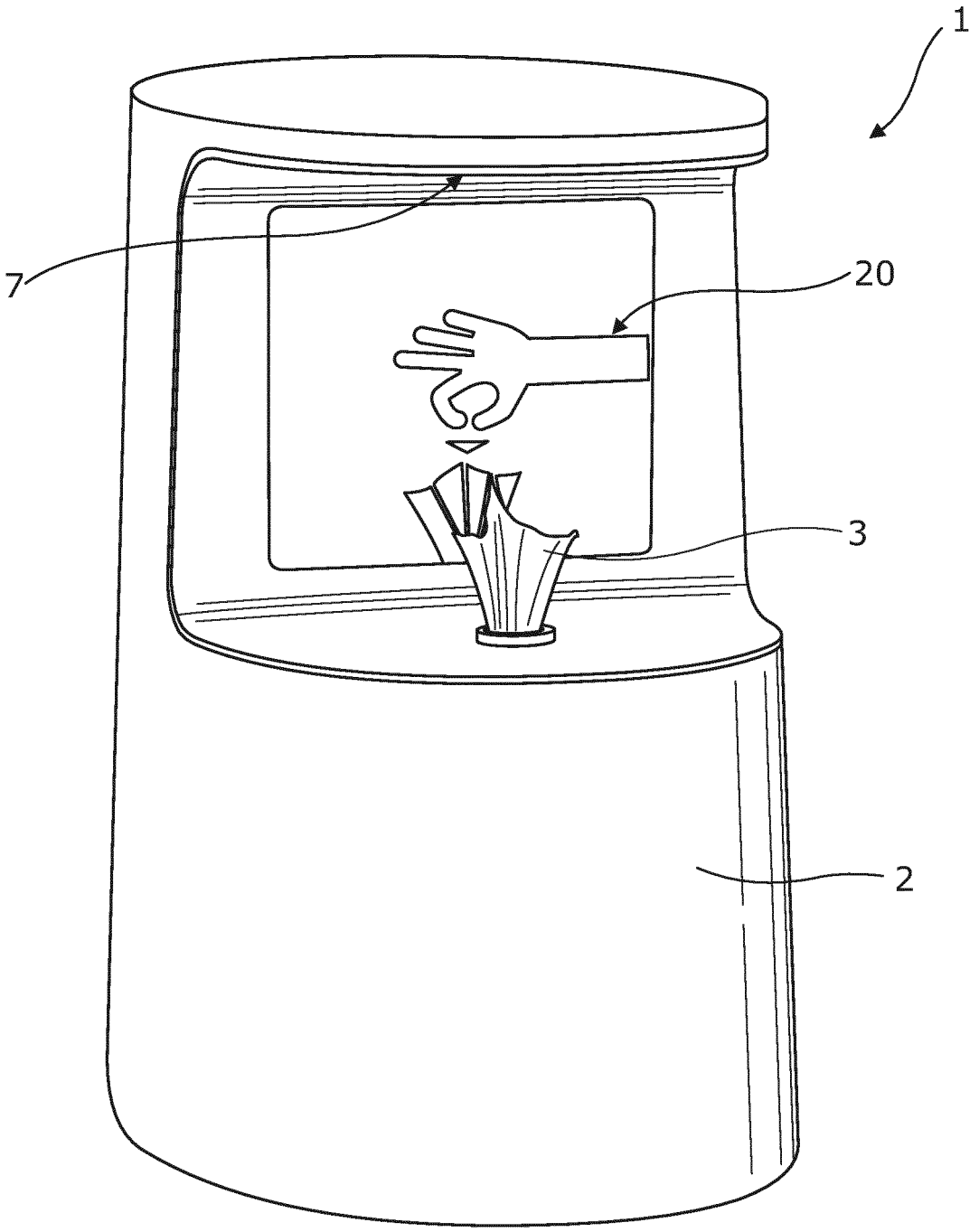
FIG. 5 shows another hygiene nudging system according to the invention.

FIG. 5 shows another embodiment of the hygiene nudging system 1 according to the invention. In this embodiment, the hygiene nudging system 1 comprises the dispenser unit 2 configured to dispense cleaning wipes 3. The control unit is comprised in the dispenser unit 2 together with the nudging unit which is connected with the control unit 4. Furthermore, the first sensor 7 is also comprised in the dispenser unit 2 and the control unit. The embodiment shown in FIG. 5 is a single device comprising at least the dispenser unit 2, cleaning wipes, control unit, the nudging unit, the indicator and the first sensor 7. In addition, the dispenser unit 2 has a sticker 20 indicating how the user may dispense cleaning wipes from the dispenser unit 2. The sticker 20 may also comprise guidance of how to use the system and as to why the system nudges the persons present in the room.

As mentioned above, the hygiene nudging system may use prescriptive analytics and is able to "determine actions to take to make the future happen". Accordingly, by applying the system according to the invention, it is possible to understand the activities in rooms/areas continuously and with that information guide people in real time, by nudging, to take precautionary hygiene actions. Hereby, the system introduces the unutilised cleaning capacity of the users. This leverage of cleaning capacity will have a tremendous effect, thereby improving the overall cleanliness.

By using nudging in the hygiene nudging system together with easy access to the cleaning wipe dispenser, interaction with users are facilitated, and thereby enormous idle human resources are mobilised and utilised in the cleaning of critical surfaces.

It is also important to stress that the hygiene nudging system will have an important communicative effect since it will enable e.g. nurses to discuss the importance of hygiene focus with patients and relatives, and teachers to students/pupils. The hygiene nudging system will most likely also foster a social acceptance of the necessity to clean surfaces. Today people taking hygiene precautions could be seen as hygiene crazy, but acting on a nudging signal will instead be actions from a responsible citizen.

The hygiene nudging system 1 may function in different ways, one example is:

- Load sensor detection, or data signals from other systems, indicating time for surface cleaning (e.g. after predefined algorithm or due to complementing sensor signals);
- User-nudging-indication by flashing (with a special USER colour) indicating the need for surfacing cleaning;
- If no action from users, the system will detect the next professional staff entering the room and use a Professional-nudging-indication (with a special professional colour and/or sound/vibration);
- The dispenser unit detects when cleaning wipes are removed from the cleaning wipe dispenser and the nudging indication will stop;
- The dispenser unit settings allow the professional to determine different time slots, in which the dispenser unit does not nudge (e.g. during night or during different user focus periods);
- If the sensor detects low battery, low cleaning wipe capacity or in other ways detect malfunctions, it will advise professionals to take action. This can be combined with a special light-signal combination so the user will understand that the system is out of service.

Although the invention has been described in the above in connection with preferred embodiments of the invention, it will be evident for a person skilled in the art that several modifications are conceivable without departing from the invention as defined by the following claims.

The invention claimed is:

1. A hygiene nudging system for improving the overall cleanliness of a room or an area having one or more predetermined surfaces, comprising a dispenser unit configured to dispense cleaning wipes for cleaning the one or more surfaces, a control unit connected with the dispenser unit, wherein the system comprises a nudging unit connected with the control unit, the control unit being configured to control the nudging unit, the nudging unit is configured to issue an indication to clean the one or more predetermined surfaces when activated by the control unit wherein the one or more predetermined surfaces includes a door handle, a desk, a table, a finger activated switch, and/or a critical hand touch site that is subject to frequent touching by human hands and/or fingers, and a first sensor is connected with the dispenser unit and the control unit, the first sensor being configured to detect dispensing from the dispenser unit and to signal the detection of dispensing to the control unit, whereby the control unit deactivates the nudging unit.

2. A hygiene nudging system according to claim 1, wherein the dispenser unit comprises a cleaning wipe dispenser with a supply of wet cleaning wipes, the wet cleaning wipes being wetted by a first disinfectant.

3. A hygiene nudging system according to claim 1, wherein the dispenser unit comprises a movement sensor configured to detect movement, whereby the cleaning wipe dispenser and/or disinfectant dispenser is/are activated for dispensing.

4. A hygiene nudging system according to claim 1, wherein the first sensor is configured to detect consumption of cleaning wipes and/or disinfectant.

5. A hygiene nudging system according to claim 1, wherein the indication is light, colour, sound and/or vibration.

6. A hygiene nudging system according to claim 1, further comprising a second sensor configured to detect movements in the room and load of the room.

7. A hygiene nudging system according to claim 6, wherein the second sensor is a passive infrared (PIR) sensor.

8. A hygiene nudging system according to claim 6, wherein the second sensor is a LIDAR sensor.

9. A hygiene nudging system according to claim 6, wherein the control unit is configured to activate the nudging unit on the basis of data received from the second sensor.

10. A hygiene nudging system according to claim 1, wherein the control unit is configured to store data regarding signals received from the sensors.

11. A hygiene nudging system according claim 1, wherein the control unit is configured to activate the nudging unit at predetermined time intervals.

12. A hygiene nudging system according to claim 1, wherein the control unit is configured to activate and deactivate the nudging unit at predetermined times.

13. A hygiene nudging system according to claim 12, wherein the control unit is configured to activate the nudging unit at predetermined times during the day when higher loads are expected, and to deactivate the nudging unit at night when lower loads are expected.

14. A hygiene nudging system according to claim 1, wherein the control unit is configured to deactivate the nudging unit when the dispenser unit has not dispensed any cleaning wipes for a predetermined period of time.

15. A hygiene nudging system according to claim 1, wherein one or more stickers or indicators are provided on the predetermined surfaces in the room or area for guiding a person to the predetermined surfaces to be wiped by means of the cleaning wipes dispensed from the dispenser unit.

16. A hygiene nudging system according to claim 1, wherein the control unit is configured to activate the nudging unit to issue a first type of nudge signal to urge a user to perform surface wiping on the one or more surfaces and to issue a second type of nudge signal if dispensing of one or more of the wipes does not occur, the first type of nudge signal and the second type of nudge signal being different from one another.

17. A facility comprising one or more hygiene nudging systems according to claim 1.

18. A monitoring and nudging system comprising a central control unit configured to receive data from one or more hygiene nudging system(s) according to claim 1.

19. A method for improving an overall cleanliness of a room or an area having one or more predetermined surfaces, comprising:

arranging a hygiene nudging system according to claim 1, activating the nudging unit for guiding a person in the room or area to the dispenser unit via an indication, and dispensing a cleaning wipe to the person for encouraging the person to take the cleaning wipe for cleaning one or more of the predetermined surfaces.

20. A method according to claim 19, comprising detecting the dispensing of a cleaning wipe, and deactivating the indication of the nudging unit.

21. A method according to claim 19, comprising reactivating the nudging unit after a predetermined period of time and/or after detecting a load of the room or area above a certain threshold.

22. A method according to claim 19, further comprising arranging stickers or indicators on the one or more predetermined surfaces for visualising them for the persons in the room or area.

* * * * *